US008770581B2

(12) United States Patent
Deno

(10) Patent No.: US 8,770,581 B2
(45) Date of Patent: Jul. 8, 2014

(54) SKEW CORRECTING DEVICE AND IMAGE FORMING APPARATUS WITH SEPARATING MECHANISM

(71) Applicant: Canon Kabushiki Kaisha, Tokyo (JP)

(72) Inventor: Kohei Deno, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/682,656

(22) Filed: Nov. 20, 2012

(65) Prior Publication Data

US 2013/0134663 A1 May 30, 2013

(30) Foreign Application Priority Data

Nov. 29, 2011 (WO) ..... PCT/JP2011/077457

(51) Int. Cl.
*B65H 7/02* (2006.01)
*B65H 9/00* (2006.01)

(52) U.S. Cl.
CPC ..... *B65H 9/006* (2013.01)
USPC ..... 271/228; 271/242; 271/273

(58) Field of Classification Search
USPC ..... 271/228, 242, 246, 273
See application file for complete search history.

(56) References Cited

U.S. PATENT DOCUMENTS 3,652,083 A * 3/1972 Bosshardt ..... 271/246
5,681,036 A * 10/1997 Wakahara et al. ..... 271/228
5,918,876 A * 7/1999 Maruyama et al. ..... 271/228
6,059,285 A * 5/2000 Suga et al. ..... 271/228
6,585,439 B2 * 7/2003 Johnson et al. ..... 400/642
6,805,347 B2 * 10/2004 Kuramoto ..... 271/242
7,467,793 B2 * 12/2008 Tanabe ..... 271/246
8,002,276 B2 * 8/2011 Ishikawa et al. ..... 271/242
8,025,288 B2 * 9/2011 Shoji et al. ..... 271/242
8,348,266 B2 * 1/2013 Deno ..... 271/246

FOREIGN PATENT DOCUMENTS

JP 6-345294 A 12/1994
JP 11-208940 A 8/1999
JP 2003-160260 A 6/2003
JP 2007-106572 A 4/2007

* cited by examiner

*Primary Examiner* — Gerald McClain
(74) *Attorney, Agent, or Firm* — Canon USA Inc IP Division

(57) ABSTRACT

A skew correcting device includes a first roller pair configured to nip and convey a sheet, a second roller pair disposed upstream of the first roller pair and configured to nip and convey the sheet, a contact portion disposed downstream of the first roller pair, the contact portion being a portion that the leading edge of the conveyed sheet comes into contact to correct skew of the sheet, a switching mechanism configured to change a nipping force of the first roller pair before the leading edge of the conveyed sheet comes into contact with the contact portion to form a loop in the sheet, and a control unit configured to make a determination on the basis of sheet information as to whether the nipping force of the first roller pair is to be changed, the control unit being configured to control the switching mechanism on the basis of the determination.

15 Claims, 14 Drawing Sheets

FIG. 6

| | | BASIS WEIGHT | | | |
|---|---|---|---|---|---|
| | SHEET WIDTH mm | 52–180 g/m$^2$ | 181–209 g/m$^2$ | 210–256 g/m$^2$ | 257–300 g/m$^2$ |
| POSTCARD | 100 | × | × | × | ✓ |
| STMT_R | 139.7 | × | × | × | ✓ |
| A5R | 148 | × | × | × | ✓ |
| B5R | 182 | × | × | × | ✓ |
| 16K | 189.5 | × | × | × | ✓ |
| EXE | 190.5 | × | × | × | ✓ |
| A4R | 210 | × | × | ✓ | ✓ |
| LGL, LTR_R | 215.9 | × | × | ✓ | ✓ |
| B4, B5 LANDSCAPE | 257 | × | × | ✓ | ✓ |
| 8K | 270 | × | × | ✓ | ✓ |
| LDR, LTR LANDSCAPE | 279.4 | × | ✓ | ✓ | ✓ |
| A3, A4 LANDSCAPE | 297 | × | ✓ | ✓ | ✓ |
| 12"×18" | 304.8 | × | ✓ | ✓ | ✓ |
| SRA3 | 320 | × | ✓ | ✓ | ✓ |
| 13"×19.2" | 330.2 | × | ✓ | ✓ | ✓ |

SKEW CORRECTING DEVICE AND IMAGE FORMING APPARATUS WITH SEPARATING MECHANISM

TECHNICAL FIELD

The present disclosure relates to a skew correcting device that corrects skew of a sheet, and also relates to an image forming apparatus that includes the skew correcting device.

BACKGROUND ART

To form an image on a sheet without skew, an image forming apparatus that forms an image on a sheet includes a skew correcting device for correcting skew of a sheet conveyed to an image forming unit.

For example, there is a skew correcting device that typically includes registration rollers or shutters on a conveying path between a sheet feeder for feeding a sheet and an image forming unit, the rollers or shutters being disposed upstream of the image forming unit. In this configuration, a roller pair (hereinafter referred to as an upstream roller pair) disposed upstream of the rollers or shutters nips and conveys a sheet fed from the sheet feeder. Then, the upstream roller pair brings the leading edge of the sheet into contact with a contact portion of the rollers or shutters to correct skew of the leading edge of the sheet (see Patent Literature (PTL) 1).

In this configuration, the upstream roller pair nips and conveys the sheet, and brings the leading edge of the sheet into contact with the nip of the registration roller pair to form a loop in the sheet. Thus, the leading edge of the sheet is aligned with the nip, so that skew of the sheet is corrected.

CITATION LIST

Patent Literature

PTL 1 Japanese Patent Laid-Open No. 6-345294

However, in recent years, it has been demanded that image forming apparatuses be capable of forming an image on various types of sheets with different sizes, different basis weights, different degrees of surface glossiness, etc. The skew correcting device of the related art has some room for improvement in correcting skew of various types of sheets.

For example, a sheet having a large basis weight (i.e., thick paper) has high rigidity. Therefore, in skew correction, the sheet having a loop slips at the nip of the upstream roller pair. As a result, a loop of desired size necessary for correcting the skew may not be able to be formed in the sheet. On the other hand, a sheet having a small basis weight (i.e., thin paper) has low rigidity. Therefore, in skew correction, since the sheet is brought into contact with the contact portion with a weak force, a loop of desired size necessary for correcting the skew may not be able to be formed in the sheet.

If a loop of desired size cannot be formed in the sheet and the skew of the sheet cannot be corrected, an image cannot be formed at a normal position of the sheet and a defective image is produced. That is, the skew correcting device of the related art is not able to offer sufficient skew correcting performance, for example, for both thick and thin paper.

An object of the present disclosure is to provide a skew correcting device capable of offering sufficient skew correcting performance for various types of sheets.

SUMMARY OF INVENTION

The present disclosure provides a skew correcting device including a first roller pair configured to nip and convey a sheet; a second roller pair disposed upstream of the first roller pair and configured to nip and convey the sheet; a contact portion disposed downstream of the first roller pair, the contact portion being a portion that the leading edge of the conveyed sheet comes into contact to correct skew of the sheet; a switching mechanism configured to change a nipping force of the first roller pair before the leading edge of the conveyed sheet comes into contact with the contact portion to form a loop in the sheet; and a control unit configured to make a determination on the basis of sheet information as to whether the nipping force of the first roller pair is to be changed, the control unit being configured to control the switching mechanism on the basis of the determination.

Further features will become apparent from the following description of exemplary embodiments with reference to the attached drawings.

BRIEF DESCRIPTION OF DRAWINGS

FIG. 6 is a table indicating the need for separation of a first upper roller 115*a*.

DESCRIPTION OF EMBODIMENTS

Preferred embodiments of the present disclosure will now be described with reference to the drawings.

Figure 15:
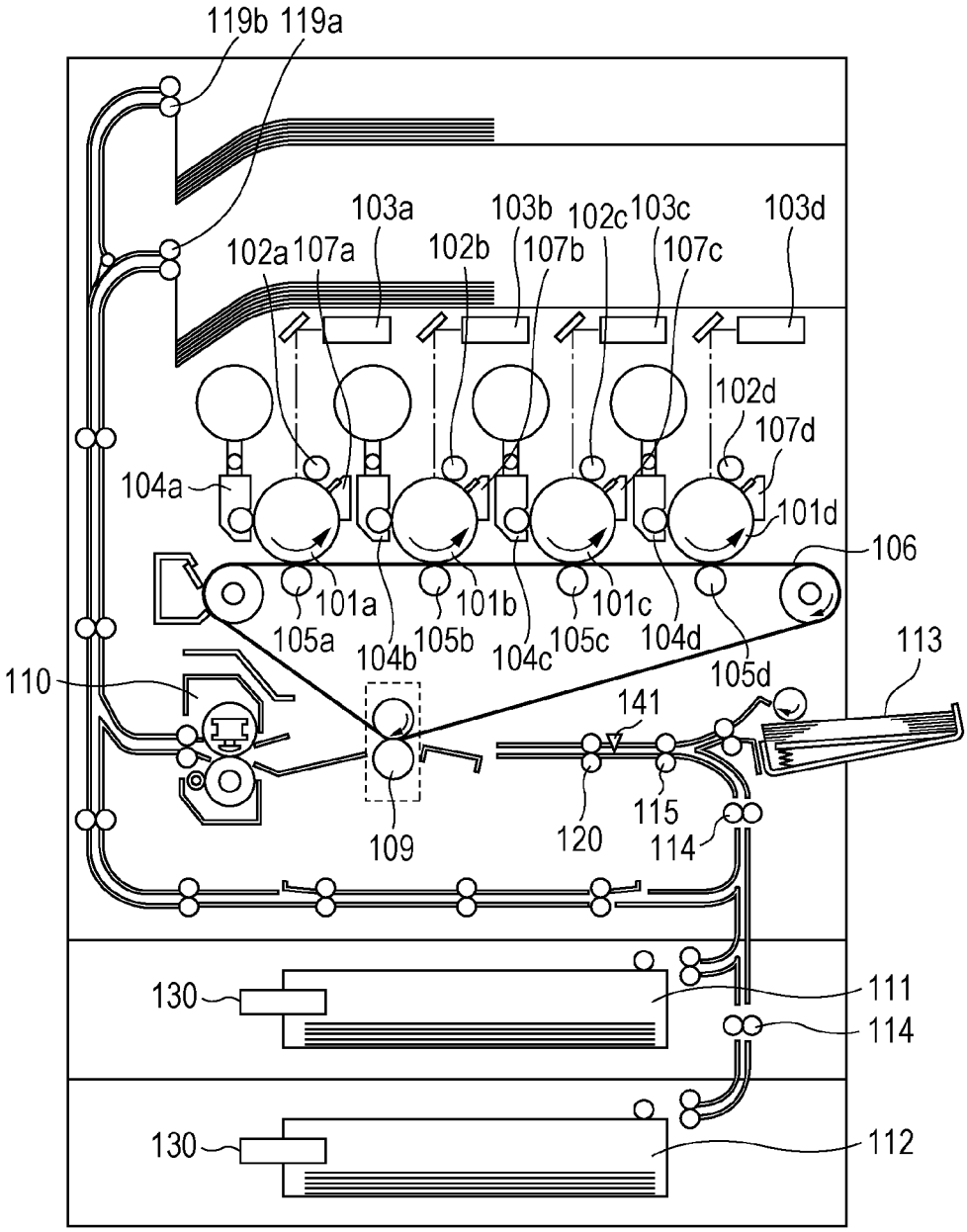
FIG. 15 illustrates an image forming apparatus that includes a skew correcting device.

FIG. 15 is a schematic cross-sectional view of a color digital printer which is an example of an image forming apparatus that includes a skew correcting device.

First, an image forming unit will be described. Surfaces of four photosensitive drums 101*a* to 101*d* are uniformly charged with electric charges by charging rollers 102*a* to 102*d*, respectively. Laser scanners 103*a* to 103*d* are supplied with image signals of yellow (Y), magenta (M), cyan (C), and black (K), respectively, and irradiate the drum surfaces with laser light in accordance with the image signals so as to neutralize the electric charges and form latent images.

The latent images formed on the photosensitive drums are developed with toners of yellow, magenta, cyan, and black by developing units 104*a* to 104*d*, respectively. The toners developed on the respective photosensitive drums are sequentially transferred by primary transfer rollers 105*a* to 105*d* onto an intermediate transfer belt 106 which is an endless-belt-like image bearing member. A full color toner image is thus formed on the intermediate transfer belt 106.

A sheet fed from a sheet feeder, which is any of paper feed cassettes 111 and 112 and a manual paper feeder 113, is conveyed by a second roller pair 114 and a first roller pair 115 toward a registration roller pair 120. The toner image on the intermediate transfer belt 106 is controlled such that there is no displacement between the image and the sheet conveyed by the registration roller pair 120. The toner image is transferred to the sheet by a secondary transfer outer roller 109. The toner image is subjected to heat and pressure and fixed onto the sheet by a fixing device 110. Then, the sheet is discharged from an ejecting unit 119*a* or 119*b* to the outside of the apparatus main body.

An operation unit 200 (see FIG. 7) of the image forming apparatus is configured to allow the user to input various sheet-related information (e.g., size information, basis weight information, and surface nature information) to a control unit (described below). Additionally, from a computer 201 connected via a network to the image forming apparatus, the user can input various sheet-related information to the control unit.

The paper feed cassettes 111 and 112 are each provided with a size detecting mechanism 130. The size detecting mechanism 130 is configured to detect the size of loaded sheets in order for the control unit of the image forming apparatus to recognize the detected size. The size detecting mechanism 130 has a turnable size detecting lever that slides in contact with and moves in synchronization with a side regulating plate, which regulates the position of the sheet in the width direction.

At a mounting portion of the apparatus main body to which the paper feed cassette is attached, the size detecting mechanism 130 has a plurality of sensors or switches at a location corresponding to the size detecting lever. Therefore, when the side regulating plate is moved along the side edges of the sheets, the size detecting lever turns in response to the movement of the side regulating plate. When the paper feed cassette is attached to the image forming apparatus, the size detecting lever selectively turns on or off detecting elements of the sensors or switches. This allows signals of different patterns to be transmitted from the sensors or switches to the main body of the image forming apparatus. On the basis of the signals, the main body of the image forming apparatus can recognize the size of the sheets loaded in the paper feed cassette. The manual paper feeder 113 may also be provided with a mechanism equivalent to the size detecting mechanism.

Since the side regulating plate is movable along the side edges of the sheets, the position of the sheet in the width direction can be adjusted to the image forming unit. The side regulating plate also has an effect of preventing the occurrence of sheet skew during sheet feeding and at conveying rollers downstream of paper feed rollers. In practice, however, sheet skew may occur due to a slight gap between the side regulating plate and a sheet. A sheet fed from the sheet feeder may be skewed while being conveyed.

Therefore, the image forming apparatus of the present embodiment includes the skew correcting device that brings the leading edge of a conveyed sheet into contact with the nip of the registration roller pair 120 which is at rest, aligns the leading edge of the sheet with the nip while forming a loop in the sheet, and thereby corrects skew of the sheet. The amount of loop formed in the sheet is adjusted when, after the sheet passes through a registration sensor 141, the sheet is further fed by a predetermined amount by the roller pairs disposed upstream of the registration roller pair 120.

First Embodiment

A first embodiment of the skew correcting device according to the present disclosure will now be described.

Figure 1:
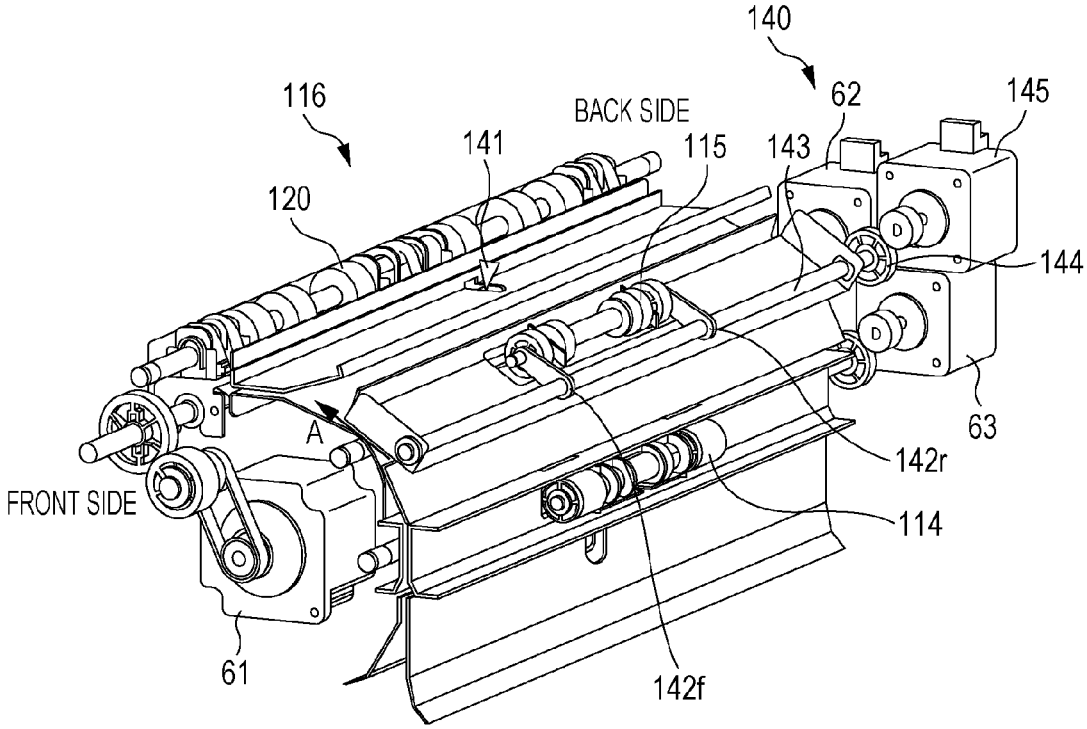
FIG. 1 illustrates a first embodiment of a skew correcting device.

FIG. 1 is a perspective view of a skew correcting device 116 which is the first embodiment. The skew correcting device 116 is disposed on a conveying path that connects the paper feed cassettes 111 and 112 and the image forming unit.

The first roller pair 115 disposed on the conveying path includes a first upper roller 115*a* and a first lower roller 115*b* disposed opposite each other. The first upper roller 115*a* has a polyacetal (POM) roller, whereas the first lower roller 115*b* is formed by a rubber roller. The first upper roller 115*a* is swingably supported by a lever or the like, and is pressed into contact with the first lower roller 115*b* by an elastic force of a spring (not shown).

Like the first roller pair 115, the second roller pair 114 disposed upstream of the first roller pair 115 includes a second upper roller 114*a* and a second lower roller 114*b* disposed opposite each other. The second upper roller 114*a* has a polyacetal (POM) roller, whereas the second lower roller 114*b* is formed by a rubber roller. The second upper roller 114*a* is swingably supported by a lever or the like, and is pressed into contact with the second lower roller 114*b* by an elastic force of a spring (not shown).

The registration roller pair 120 disposed downstream of the first roller pair 115 includes an upper roller 120*a* and a lower roller 120*b*. The registration roller pair 120 serves as a contact portion with which the leading edge of a conveyed sheet comes into contact for correction of sheet skew. The sheet skew can be corrected when the leading edge of the sheet comes into contact with and is aligned with the nip of the upper roller 120*a* and the lower roller 120*b*. The upper roller 120*a* of the registration roller pair 120 has a polyacetal (POM) roller, whereas the lower roller 120*b* of the registration roller pair 120 is formed by a rubber roller. The upper roller 120*a* and the lower roller 120*b* are disposed opposite each other. The upper roller 120*a* is swingably supported by a lever or the like, and is pressed into contact with the lower roller 120*b* by an elastic force of a spring (not shown).

Reference numeral 140 denotes a separating mechanism. The separating mechanism 140 serves as a switching mechanism that changes a force with which the first roller pair 115 nips the sheet. The separating mechanism 140 is configured to separate the first upper roller 115*a* from the first lower roller 115*b*. By separating the first upper roller 115*a* from the first lower roller 115*b*, the nipping force for nipping the sheet can be made zero.

The separating mechanism 140 includes a first-upper-roller separating motor 145, an input gear 144, a driven shaft 143 that supports the first upper roller 115*a*, and separating levers 142*f* and 142*r* that separate the first upper roller 115*a* from the first lower roller 115*b*. The input gear 144 engages with an output gear of the first-upper-roller separating motor 145. The input gear 144 is secured to an end portion of the driven shaft 143. The separating levers 142*f* and 142*r* secured to the driven shaft 143 are in contact with a shaft of the first upper roller 115*a* from below.

In this configuration, when the first-upper-roller separating motor 145 rotates to the left (or counterclockwise) in FIG. 1 by a predetermined amount, the driven shaft 143 is driven to rotate to turn the separating levers 142*f* and 142*r* to the right (or clockwise). This raises and separates the first upper roller 115*a* from the first lower roller 115*b* against an elastic force of the spring (not shown). When the first-upper-roller separating motor 145 is rotated clockwise or in the direction opposite that in the separation of the first upper roller 115*a*, the separating levers 142*f* and 142*r* are turned to the left (or counterclockwise) through the driven shaft 143. Then, the first upper roller 115*a* is pressed into contact with the first lower roller 115*b* by an elastic force of the spring (not shown).

In FIG. 1, reference numeral 62 denotes a first-roller-pair drive motor for driving the first lower roller 115*b*, and reference numeral 63 denotes a second-roller-pair drive motor for driving the second lower roller 114*b*.

Figure 7:
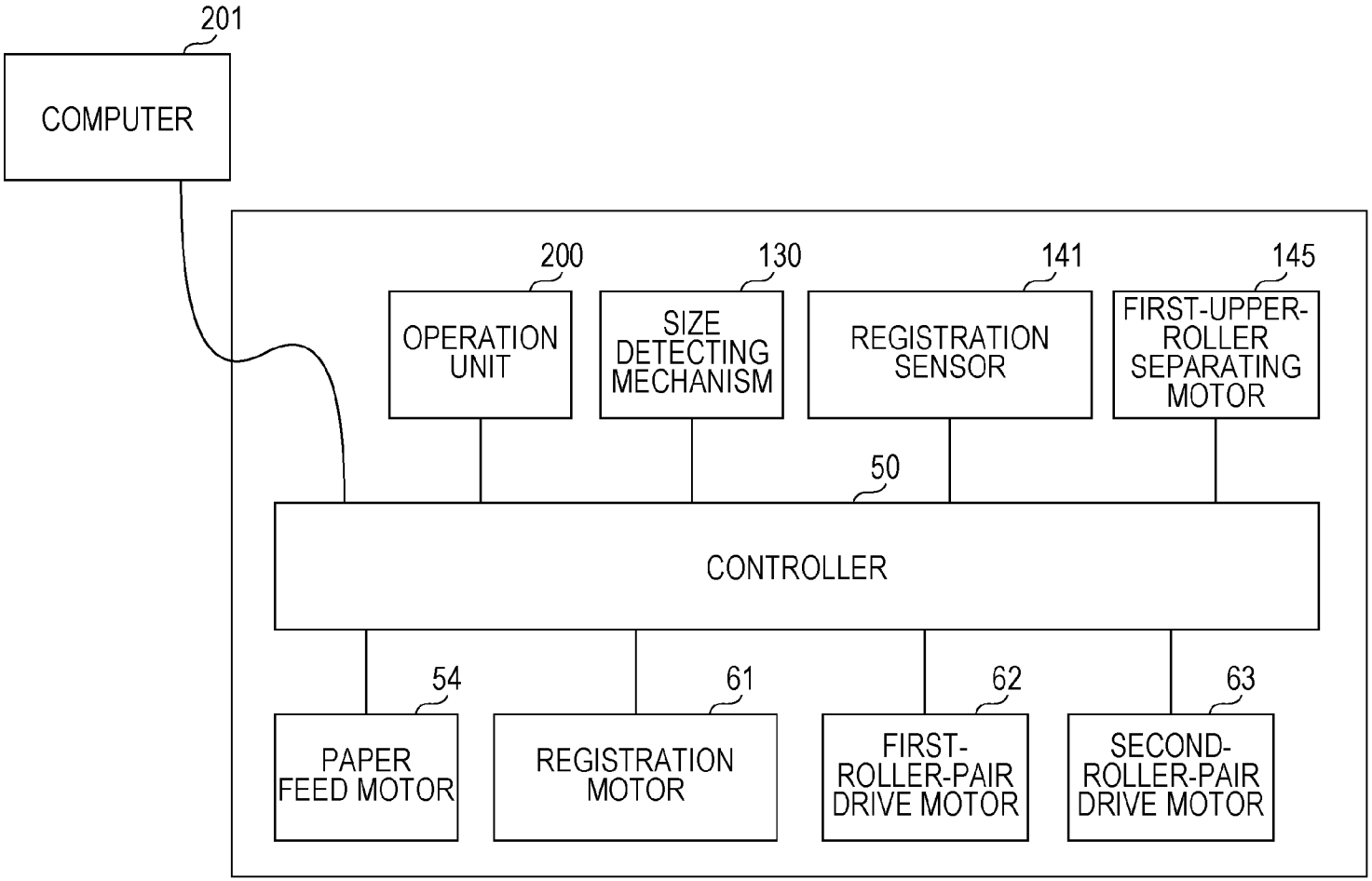
FIG. 7 is a block diagram illustrating an image forming apparatus.

As illustrated in the block diagram of FIG. 7, a controller 50 serving as a control unit is connected to the operation unit 200 and the size detecting mechanism 130 of the image forming apparatus. The controller 50 is also connected to the registration sensor 141, the first-upper-roller separating motor 145, a registration motor 61, a paper feed motor 54, the first-roller-pair drive motor 62, and the second-roller-pair drive motor 63.

The controller 50 controls the separating mechanism 140 so as to change the nipping force of the first roller pair 115 on the basis of, for example, the size and basis weight of the sheet (hereinafter referred to as sheet information). In the present embodiment, the controller 50 determines the need for separation of the first upper roller 115*a* on the basis of sheet information specified by the user, sheet information detected by the size detecting mechanism 130, or the combination of both.

A specific example will now be described. The table of FIG. 6 shows an example of sheet information (sheet width and sheet basis weight) and the corresponding need for separation of the first upper roller 115*a* from the first lower roller 115*b*. In FIG. 6, a check mark indicates that the first upper roller 115*a* needs to be separated from the first lower roller 115*b*, whereas a cross mark indicates that the first upper roller 115*a* does not need to be separated from the first lower roller 115*b*. Hereinafter, separating the first upper roller 115*a* from the first lower roller 115*b* will be described as "separation of the first roller pair 115".

If the basis weight of the sheet is from 52 g/m$^2$ to 180 g/m$^2$, the separation of the pair of first rollers 115 is not performed regardless of the width of the sheet.

If the basis weight of the sheet is from 181 g/m$^2$ to 209 g/m$^2$, the need for separation of the first roller pair 115 varies depending on the width of the sheet. If the width of the sheet is 100 mm or more and less than 279.4 mm, the separation of the first roller pair 115 is not performed, whereas if the width of the sheet is 279.4 mm or more and 330.2 mm or less, the separation of the first roller pair 115 is performed.

If the basis weight of the sheet is from 210 g/m$^2$ to 256 g/m$^2$, the need for separation of the first upper roller 115*a* varies depending on the width of the sheet. If the width of the sheet is 100 mm or more and less than 210 mm, the separation of the first roller pair 115 is not performed, whereas if the width of the sheet is 210 mm or more and 330.2 mm or less, the separation of the first roller pair 115 is performed.

If the basis weight of the sheet is from 257 g/m$^2$ to 300 g/m$^2$, the separation of the first roller pair 115 is performed regardless of the width of the sheet. As described above, the controller 50 determines the need for separation of the first roller pair 115 by using the sheet width and the sheet basis weight as sheet information. Note that the present invention is not to be limited to the specific numerical values described above. Depending on the apparatus characteristics or the like, any numerical values may be used to determine the need for separation of the first roller pair 115. Also note that the sheet information is information about at least one of the following: sheet type, sheet size, and sheet basis weight.

A description will now be given as to why the need for separation of the first roller pair 115 is determined on the basis of sheet information.

For correcting skew of a sheet having a small basis weight (i.e., a sheet of low rigidity, such as so-called thick paper), a loop reaction force of the sheet is weak. This means that the sheet comes into contact with the registration roller pair with a weak force. Therefore, since a loop of desired size cannot be formed in the sheet, the skew of the sheet may not be able to be corrected.

Figure 14:
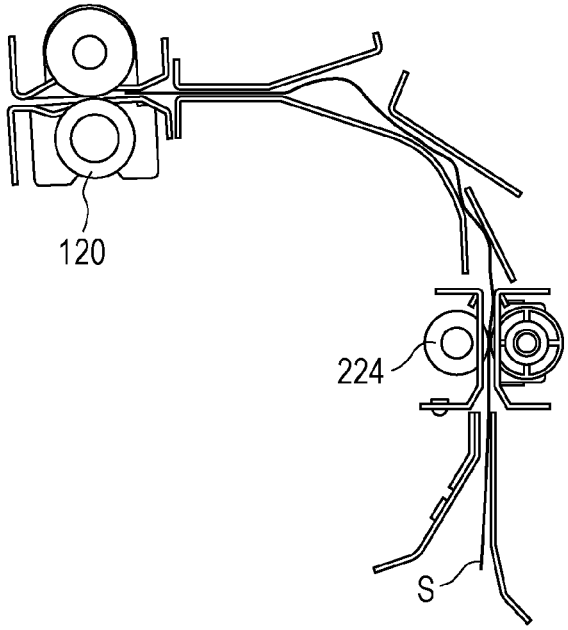
FIG. 14 illustrates a state in which a sheet is buckled on a conveying path in a skew correcting device of the related art.

A description will be given as to why the sheet having a small basis weight cannot form a loop of desired size. Since image forming apparatuses available today are small in size, a conveying path between a sheet feeder and registration rollers is often short and curved. Typically, conveying rollers are spaced apart to an extent which allows conveyance of a minimum size sheet on which an image can be formed by the image forming apparatus. FIG. 14 illustrates an example where rollers are spaced apart in this typical manner. In the example of FIG. 14, the registration roller pair 120 and an upstream roller pair 224 are spaced apart, with a curved conveying path therebetween, to an extent which allows conveyance of a minimum size sheet. In this case, there is a location where a distance between swinging guides is widened by a gap or joint between the guides. In the location where the distance between the guides is widened, a sheet having a small basis weight may be buckled, so that the sheet may not be able to be properly conveyed to the registration rollers. The present embodiment solves this problem by disposing the first roller pair 115 between the registration rollers 120 and the second roller pair 114.

However, if the first roller pair 115 is disposed between the registration rollers 120 and the second roller pair 114, skew of a sheet having a large basis weight (i.e., a sheet of high rigidity, such as so-called thin paper) is not corrected properly. Specifically, when a loop is formed to correct skew of a sheet having a large basis weight, a force with which the sheet tries to return from a looped state to a flat state (hereinafter referred to as a loop reaction force) is large. Then, if the loop reaction force exceeds the force with which the first roller pair 115 nips the sheet, the sheet slips at the nip of the first roller pair 115. Since this degrades the conveying force of the first roller pair 115, a loop of desired size cannot be formed in the sheet and thus the skew of the sheet cannot be corrected.

Generally, when a sheet is conveyed from a roller pair upstream of a registration roller pair and comes into contact with the registration roller pair to form a loop, the shape of the loop depends on the distance between the registration roller pair and the upstream roller pair. Hereinafter, the distance between the registration roller pair and the upstream roller pair will be referred to as an inter-roller distance. The longer the inter-roller distance, the gentler the loop; and the shorter the inter-roller distance, the sharper the loop. Also, the gentler the loop of the sheet, the smaller the loop reaction force; and the sharper the loop of the sheet, the larger the loop reaction force.

In the first embodiment, made in view of the circumstances described above, the inter-roller distance can be changed by separating or closing the first roller pair 115 on the basis of sheet information. That is, in the first embodiment, the need for separation of the pair of first rollers 115 is determined on the basis of sheet information, such as a sheet basis weight indicating whether the conveyed sheet is either thick or thin paper. By changing the inter-roller distance, it is possible to form an appropriate amount of loop for various types of sheets and improve skew correcting performance.

A sheet skew correcting operation of the skew correcting device 116 will now be described.

First, a skew correcting operation which does not involve separation of the first roller pair 115 will be described.

Figure 2A:
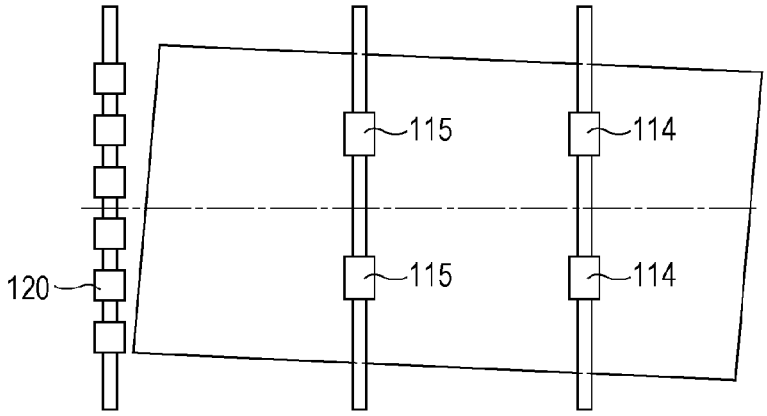
FIG. 2A illustrates a sheet skew correcting operation according to the first embodiment.
Figure 2B:
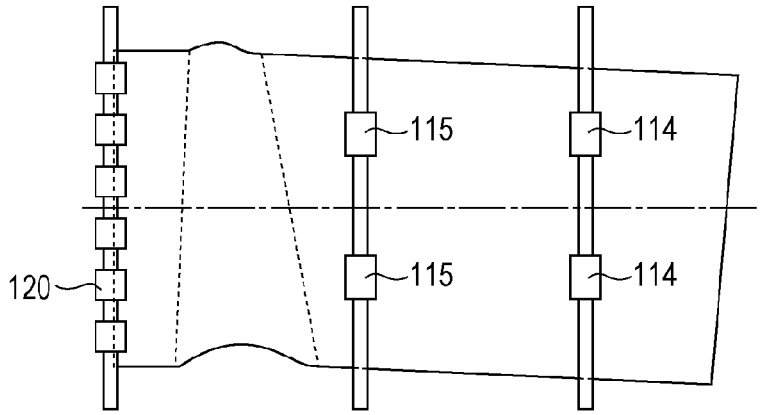
FIG. 2B illustrates the sheet skew correcting operation according to the first embodiment.
Figure 2C:
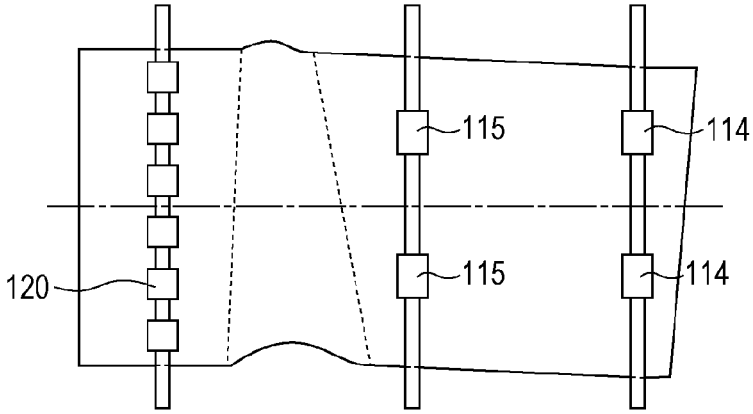
FIG. 2C illustrates the sheet skew correcting operation according to the first embodiment.
Figure 3A:
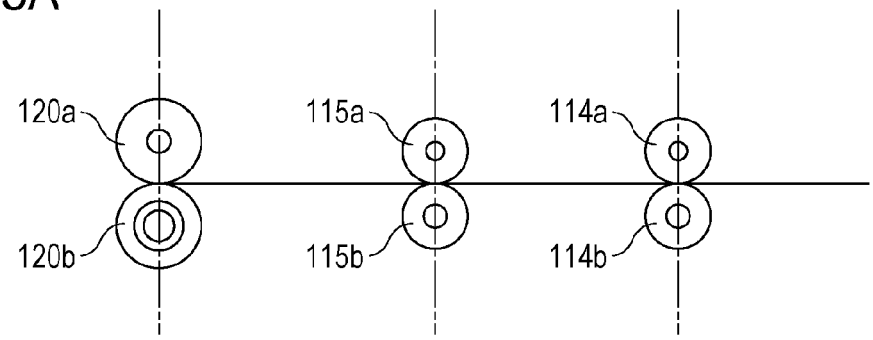
FIG. 3A illustrates the sheet skew correcting operation according to the first embodiment.
Figure 3B:
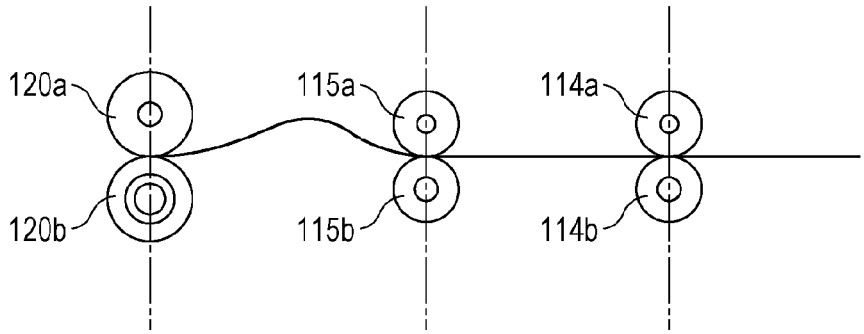
FIG. 3B illustrates the sheet skew correcting operation according to the first embodiment.
Figure 3C:
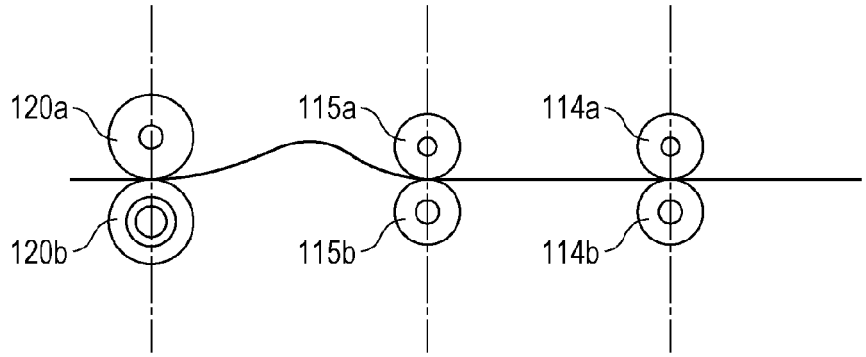
FIG. 3C illustrates the sheet skew correcting operation according to the first embodiment.

FIG. 2A to FIG. 2C and FIG. 3A to FIG. 3C are schematic diagrams illustrating a sheet skew correcting operation which does not involve separation of the first roller pair 115. FIG. 2A to FIG. 2C are plan views as viewed from above, and FIG. 3A to FIG. 3C are side views corresponding to FIG. 2A to FIG. 2C, respectively.

A description will be given as to a skew correcting operation performed when a sheet is skewed to the left (see FIG. 2A) with respect to a conveying direction A. In the state of FIG. 2A, when the first roller pair 115 rotates to convey the sheet in the conveying direction A, the left end portion of the leading edge of the sheet, in the conveying direction A, comes into contact with the nip of the registration rollers 120 which are not rotating.

When the first rollers 115 further rotate to convey the sheet in the conveying direction A, the entire leading edge of the sheet, in the conveying direction A, comes into contact with the nip of the registration roller pair 120 as illustrated in FIG. 2B and FIG. 3B. At this point, a loop is formed in the sheet between the registration roller pair 120 and the first roller pair 115. The skew of the sheet is thus corrected.

Then, the registration roller pair 120 rotates to convey the skew-corrected sheet S as illustrated in FIG. 2C and FIG. 3C.

Next, a skew correcting operation which involves separation of the first roller pair 115 will be described.

Figure 4A:
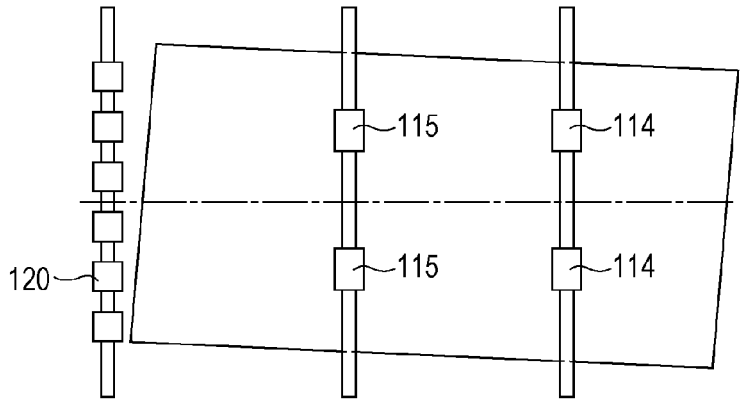
FIG. 4A illustrates another sheet skew correcting operation according to the first embodiment.
Figure 4B:
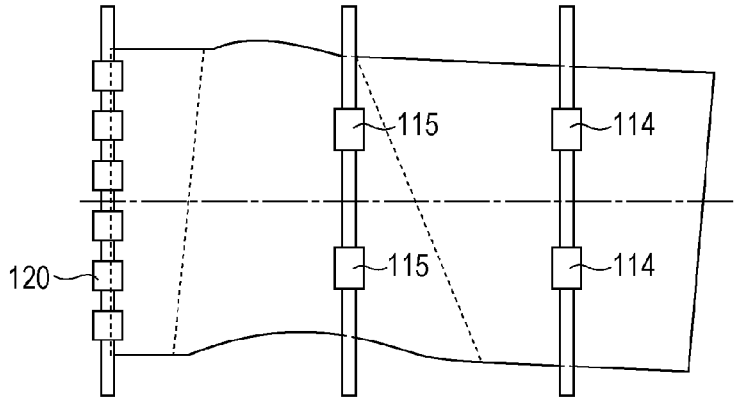
FIG. 4B illustrates the sheet skew correcting operation according to the first embodiment.
Figure 4C:
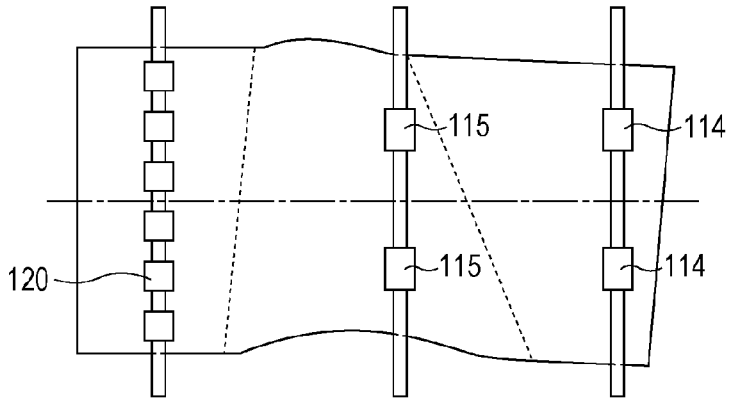
FIG. 4C illustrates the sheet skew correcting operation according to the first embodiment.
Figure 5A:
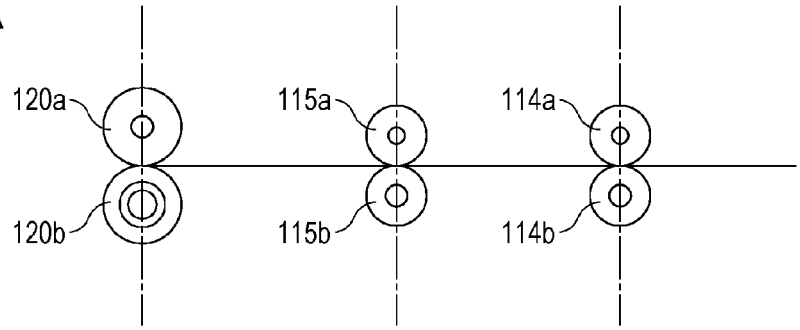
FIG. 5A illustrates the sheet skew correcting operation according to the first embodiment.
Figure 5B:
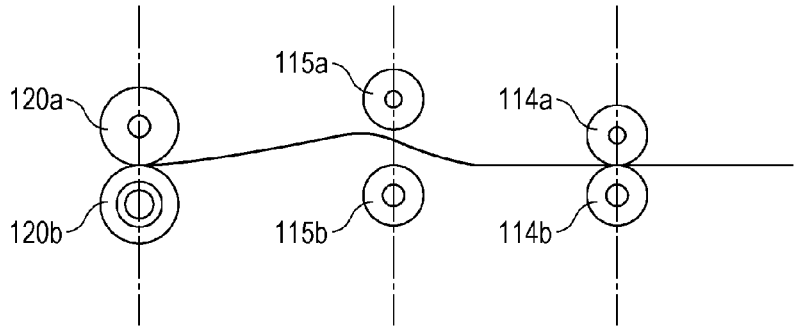
FIG. 5B illustrates the sheet skew correcting operation according to the first embodiment.
Figure 5C:
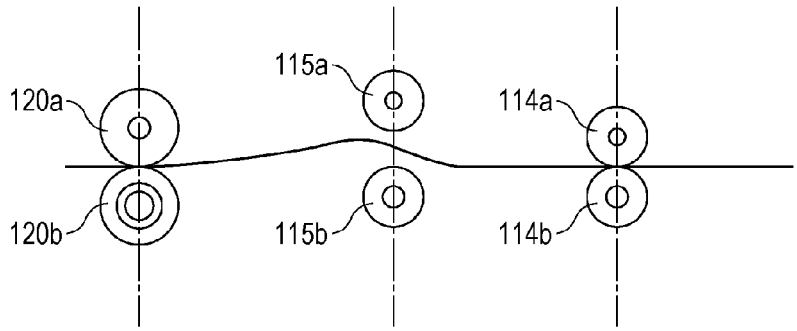
FIG. 5C illustrates the sheet skew correcting operation according to the first embodiment.

FIG. 4A to FIG. 4C and FIG. 5A to FIG. 5C are schematic diagrams illustrating a sheet skew correcting operation which involves separation of the first roller pair 115. FIG. 4A to FIG. 4C are plan views as viewed from above, and FIG. 5A to FIG. 5C are side views corresponding to FIG. 4A to FIG. 4C, respectively.

A description will be given again as to a skew correcting operation performed when a sheet is skewed to the left with respect to the conveying direction A. As illustrated in FIG. 4A, when the second roller pair 114 and the first roller pair 115 rotate, the sheet is conveyed in the conveying direction A. Then, before the left end portion of the leading edge of the sheet, in the conveying direction A, comes into contact with the nip of the registration rollers 120 to form a loop, the first upper roller 115*a* is separated. The registration rollers 120 are not rotating at this point.

When the first roller pair 115 further rotates to convey the sheet in the conveying direction A, the entire leading edge of the sheet, in the conveying direction A, comes into contact with the nip of the registration roller pair 120, as illustrated in FIG. 4B and FIG. 5B, to form a loop in the sheet. The skew of the sheet is thus corrected. The first roller pair 115 is still separated at this point.

Then, the registration roller pair 120 rotates to convey the skew-corrected sheet S as illustrated in FIG. 4C and FIG. 5C.

As described above, when the sheet comes into contact with the nip of the registration rollers while the first roller pair 115 is separated, a loop formed in the sheet is gentler in shape than that in the case where the first roller pair 115 is not separated. That is, when the first roller pair 115 is not separated, a loop is formed in the sheet between the registration roller pair 120 and the first roller pair 115. On the other hand, when the first roller pair 115 is separated, a loop is formed in the sheet between the registration roller pair 120 and the second roller pair 114. Therefore, when the first roller pair 115 is separated, the loop reaction force of the sheet is smaller and the sheet does not slip even if it is thick paper having a large basis weight.

The first roller pair 115 may be separated any time before the sheet comes into contact with the nip of the registration roller pair 120 to form a loop. For stable conveyance, however, it is preferable that the first roller pair 115 be separated after the leading edge of the sheet passes through the first roller pair 115. The first upper roller 115*a* may be pressed into contact with the first lower roller 115*b* any time before the subsequent sheet is conveyed to reach the first roller pair 115.

Figure 8:
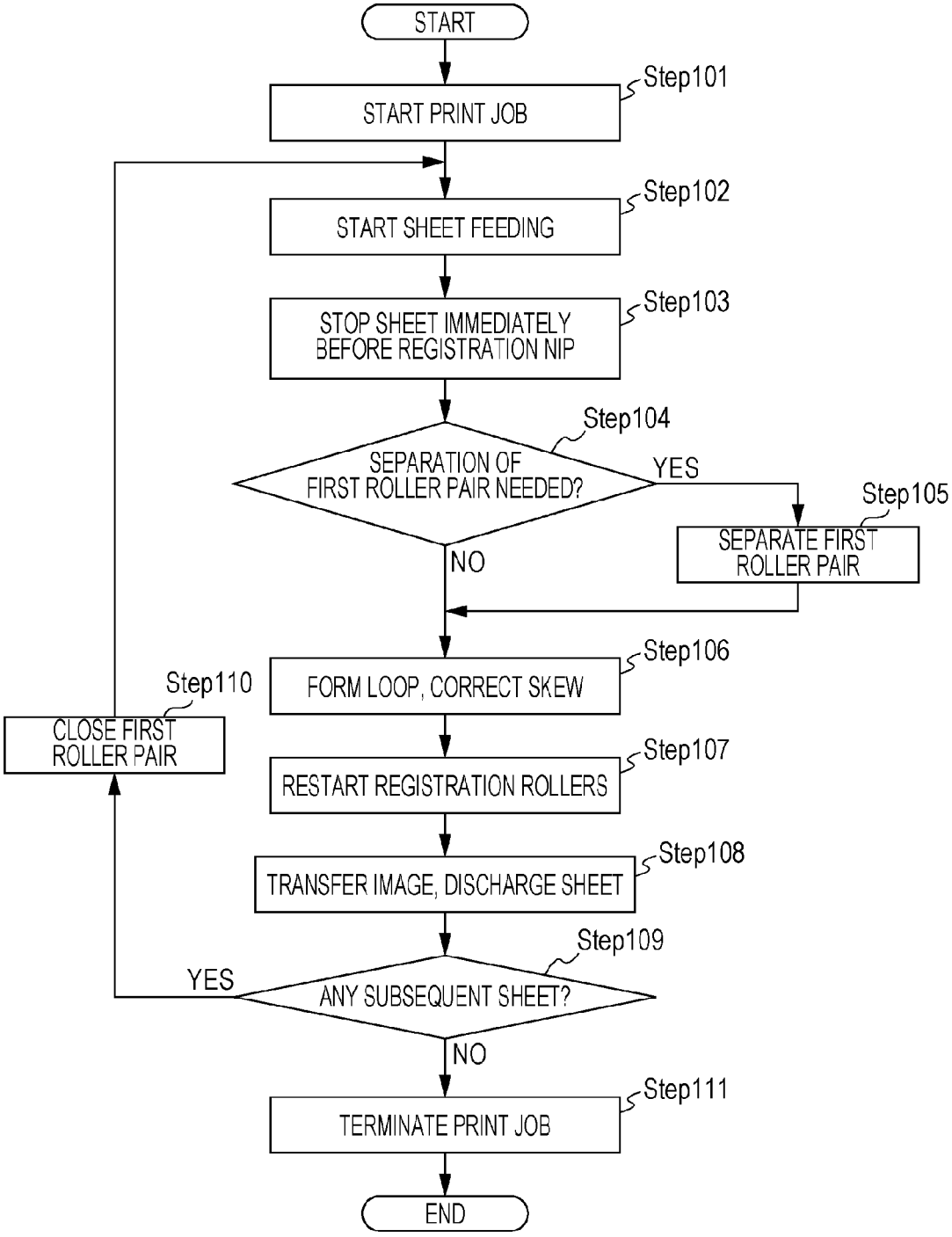
FIG. 8 is a flowchart illustrating a skew correcting operation of a skew correcting device.
Figure 9:
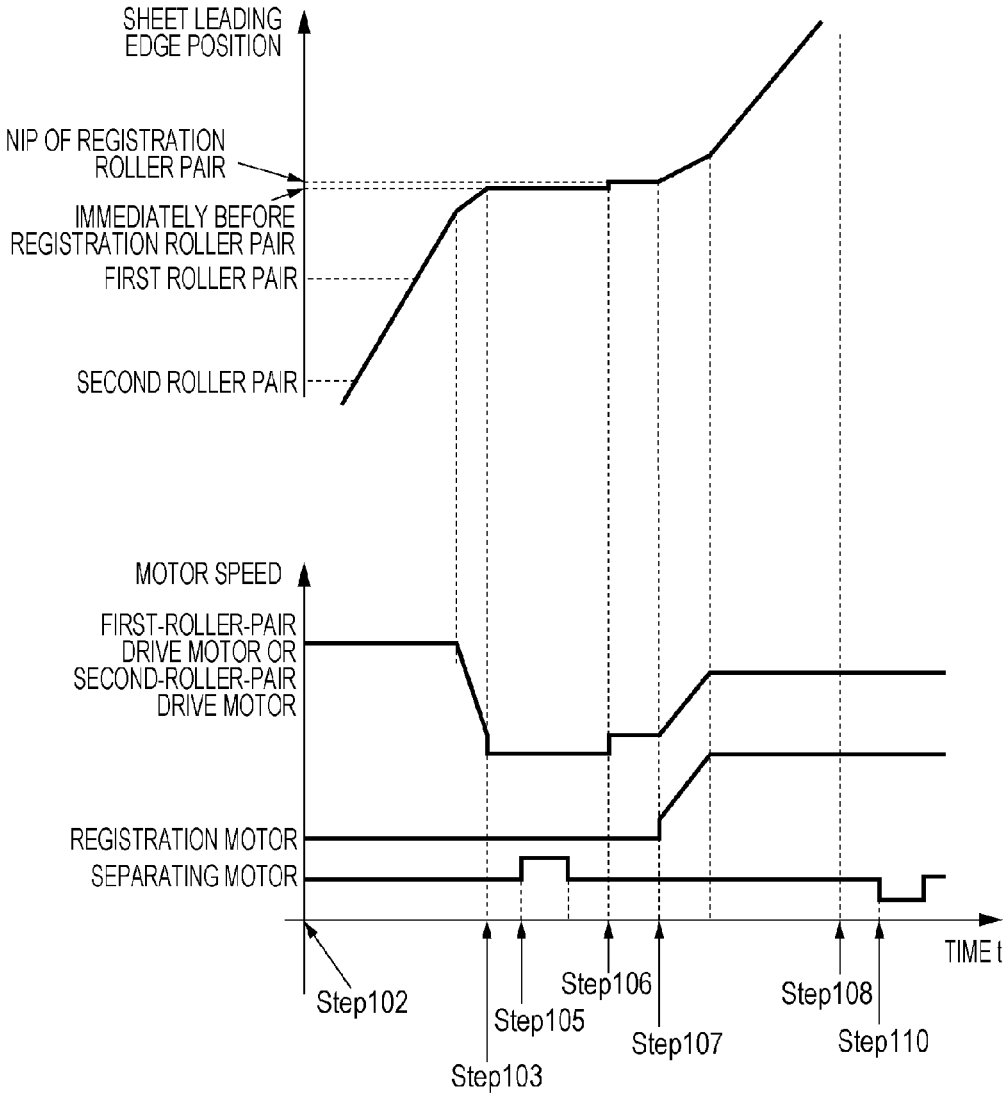
FIG. 9 provides a diagram illustrating a leading edge position of a conveyed sheet, and a diagram illustrating drive operations of motors.

A flow of a sheet skew correcting operation of the skew correcting device 116 according to the first embodiment, based on the block diagram of FIG. 7, will be described with reference to FIG. 8. FIG. 9, which corresponds to FIG. 8, provides a diagram illustrating a leading edge position of a conveyed sheet, and a diagram illustrating drive operations of the registration motor 61, first-roller-pair drive motor 62, and second-roller-pair drive motor 63.

First, the user executes a print job from the operation unit 200 of the image forming apparatus, or from the computer 201 connected directly or via the network to the image forming apparatus (Step 101). At the same time, the user can specify the number of copies to be printed and sheet information about sheets to be used. The sheet information may be detected by the size detecting mechanism 130.

When the print job is executed, a sheet feeding operation is started (Step 102). A sheet is conveyed through the second roller pair 114 and the first roller pair 115 to the registration sensor 141. When the conveyed sheet is detected by the registration sensor 141, the first rollers 115 and the second rollers 114 stop rotating to stop the sheet immediately before the nip of the registration roller pair 120 (Step 103). This is to bring the leading edge of the sheet into contact with the nip of the registration roller pair 120 at low speed.

The controller 50 stores, in advance, a table (such as that of FIG. 6) in which sheet information is associated with the need for separation of the first roller pair 115. The controller 50 refers to the table to determine the need for separation of the first roller pair 115 (Step 104).

If it is determined that the separation of the first roller pair 115 is needed, the first-upper-roller separating motor 145 is driven to separate the first upper roller 115*a* from the first lower roller 115*b* while the sheet is at rest (Step 105). On the other hand, if it is determined that the separation of the first roller pair 115 is not needed, the first roller pair 115 is not separated.

After the elapse of a predetermined length of time, the second roller pair 114 starts to rotate to form a loop of predetermined amount in the sheet, thereby performing a skew correcting operation (Step 106).

If the separation is needed after that, the registration roller pair 120 and the second roller pair 114 are simultaneously restarted to convey the sheet to a secondary transfer unit on the downstream side while maintaining the skew-corrected state of the sheet (Step 107). If there is no need for the separation, the registration roller pair 120, the first roller pair 115, and the second roller pair 114 are simultaneously restarted to convey the sheet.

The sheet conveyed to the secondary transfer unit is subjected to image transfer and sheet discharging operation (Step 108). Then, a determination is made as to whether there is any subsequent sheet (Step 109). If there is a subsequent sheet and the first roller pair 115 is separated, the first-upper-roller separating motor 145 is driven again to complete closing of the first roller pair 115 before the subsequent sheet is introduced into the nip of the first rollers 115 (Step 110). If there is no subsequent sheet, the print job is terminated (Step 111).

As described above, in the first embodiment, the inter-roller distance can be changed by separating or closing the first roller pair 115 on the basis of sheet information. By changing the inter-roller distance, it is possible to form an appropriate amount of loop for various types of sheets and improve skew correcting performance.

In the description above, the sheet is controlled to be stopped immediately before the nip of the registration roller pair. In the present invention, however, even if the sheet is not stopped immediately before the nip of the registration roller pair, the same effect as above can be achieved by separating the first roller pair 115 before a loop is formed in the sheet.

Second Embodiment

Figure 10:
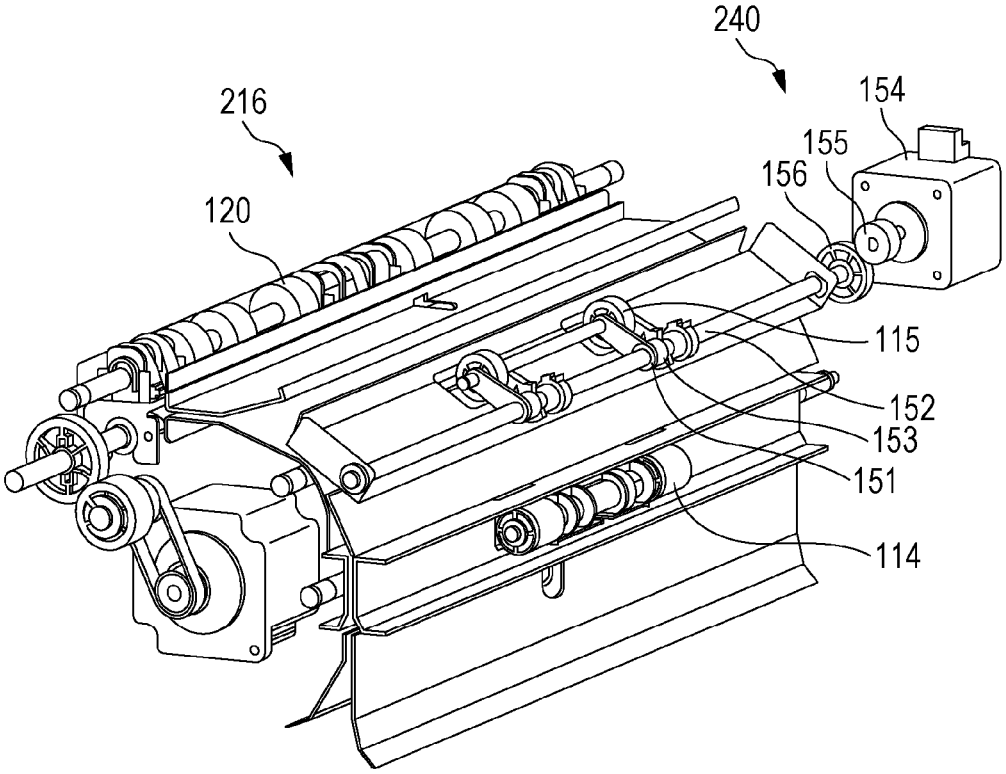
FIG. 10 illustrates a second embodiment of the skew correcting device.

A second embodiment will now be described. FIG. 10 is a perspective view of a skew correcting device 216 according to the second embodiment of the present disclosure. The second embodiment differs from the first embodiment only in the configuration of the switching mechanism. Since the other configurations are the same as those of the first embodiment, the description of the same configurations and operations will be omitted here.

In the first embodiment described above, the separating mechanism 140 that separates the first upper roller 115*a* from the first lower roller 115*b* is used as the switching mechanism. In the second embodiment, however, a pressing-force varying mechanism 240 is used as the switching mechanism. The nipping force with which the first roller pair 115 nips the sheet is changed when the pressing-force varying mechanism 240 changes the pressing force of the first roller 115*a* against the first lower roller 115*b*.

The pressing-force varying mechanism 240 of the second embodiment will now be described. The pressing-force varying mechanism 240 includes an arm member 151, a pressing-force varying drive shaft 152, a torsion coil spring 153, a pressing-force varying motor 154, a motor gear 155, and an input gear 156.

As illustrated in FIG. 10, the first upper roller 115*a* is rotatably supported by the arm member 151, which is turnably supported by the pressing-force varying drive shaft 152. The torsion coil spring 153 is disposed between the arm member 151 and the pressing-force varying drive shaft 152. The torsion coil spring 153 is attached at one end to the arm member 151, and attached at the other end to the pressing-force varying drive shaft 152.

When the pressing-force varying motor 154 rotates to the right, the pressing-force varying drive shaft 152 rotates to the left through the motor gear 155 and the input gear 156, so that the torsion coil spring 153 is compressed. This increases the pressing force (or nipping force) of the first upper roller 115*a* against the first lower roller 115*b*.

On the other hand, when the pressing-force varying motor 154 rotates to the left, the pressing-force varying drive shaft 152 rotates to the right, so that the compressive force of the torsion coil spring 153 is reduced. This reduces the pressing force (or nipping force) of the first upper roller 115*a* against the first lower roller 115*b*.

As described above, the magnitude of the pressing force can be regulated by controlling the number of pulses of the pressing-force varying motor 154.

As in the first embodiment, the pressing-force varying motor 154 is connected to the controller 50, by which the pressing-force varying motor 154 is controlled so as to change the nipping force of the first roller pair 115 on the basis of sheet information of the conveyed sheet.

The skew correcting device 216 of the second embodiment is configured such that while the sheet is temporarily at rest immediately before the registration roller pair 120, the controller 50 controls the pressing-force varying mechanism 240 so as to change the nipping force of the first roller pair 115 on the basis of the sheet information of the conveyed sheet. Then, a loop is formed in the sheet to correct skew of the sheet. Specifically, for example, if the sheet is thick paper having a large basis weight, the pressing-force varying mechanism 240 reduces the pressing force of the first roller 115*a* to reduce the nipping force of the first roller pair 115. For conveying the sheet, the nipping force of the first roller pair 115 is set to a value which allows the conveyance. If the nipping force of the first roller pair 115 is changed to be smaller, the nipping force is set to a value which allows the sheet to slip at the nip.

Therefore, in the second embodiment, if the sheet is thick paper or the like as described above, reducing the nipping force of the first roller pair 115 in forming a loop in the sheet facilitates slipping and turning of the sheet at the nip. An appropriate amount of loop cannot be formed simply by slipping of the sheet at the nip. However, since the second roller pair 114 also nips the sheet and applies a conveying force to the sheet, the sheet is conveyed in the conveying direction while turning at the first roller pair 115. It is thus possible to form an appropriate amount of loop which allows the leading edge of the sheet to come into contact with the nip of the registration roller pair 120 to correct skew.

Thus, in the second embodiment, sheet skew correcting performance can be improved as in the first embodiment. Additionally, in the second embodiment, where the first roller pair 115 is not completely separated, the time for separating and closing the first roller pair 115 can be saved.

Therefore, in the second embodiment, it is possible to improve sheet skew correcting performance without degrading productivity.

Note that sheet information and whether the pressing-force varying mechanism 240 needs to change the pressing force of the first roller 115*a* can be determined in the same manner as in the first embodiment. Also, the flow of the sheet skew correcting operation of the skew correcting device 216 according to the second embodiment can be performed in the same manner as in the first embodiment.

Third Embodiment

Figure 11:
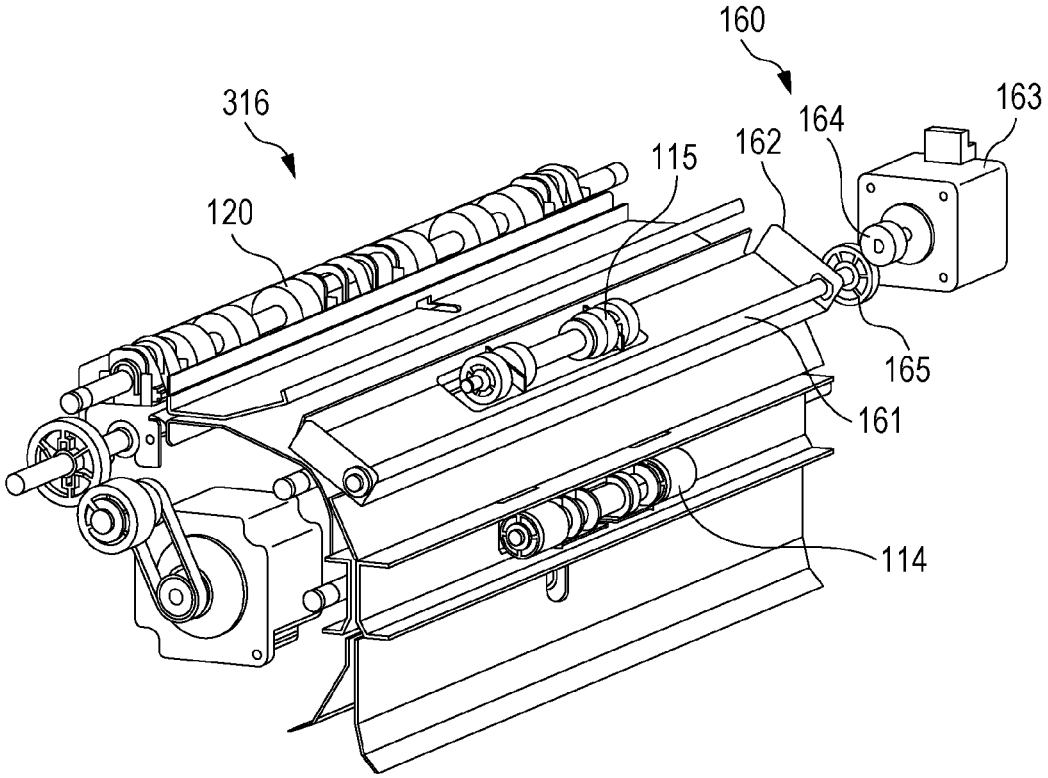
FIG. 11 illustrates a third embodiment of the skew correcting device.

A third embodiment will now be described. FIG. 11 is a perspective view of a skew correcting device 316 according to the third embodiment of the present invention. The third embodiment differs from the first embodiment only in that the skew correcting device 316 includes a loop-space varying mechanism 160. The description of the other configurations, which are the same as those of the first embodiment, will be omitted here.

The loop-space varying mechanism 160 includes a swinging guide shaft 161, a swinging guide 162 secured to the swinging guide shaft 161, a swinging motor 163, a motor gear 164 secured to an output shaft of the swinging motor 163, and an input gear 165 secured to the swinging guide shaft 161. The input gear 165 engages with the motor gear 164. As the swinging motor 163 rotates, the swinging guide shaft 161 rotates to swing the swinging guide 162.

The loop-space varying mechanism 160 is configured such that the swinging guide 162 which forms the sheet conveying path is moved to open. This is to increase a loop space which allows a loop formed in the sheet.

The swinging guide shaft 161 is rotatably supported by a frame of the apparatus main body (not shown). If the swinging-guide drive motor 163 is rotated to the left (or counterclockwise), the swinging guide shaft 161 rotates to the right (or clockwise) via the motor gear 164 and the input gear 165. Then, as illustrated in FIG. 12B, the swinging guide 162 swings in the upward direction in FIG. 12A and FIG. 12B. Conversely, if the swinging-guide drive motor 163 is rotated to the right (or clockwise), the swinging guide 162 swings (as in FIG. 12A) in the downward direction in FIG. 12A and FIG. 12B. Since the first upper roller 115*a* of the first roller pair 115 is held by the swinging guide 162, the swinging guide 162 swings upward and downward in response to the separating and closing operation of the first upper roller 115*a*.

Figure 12A:
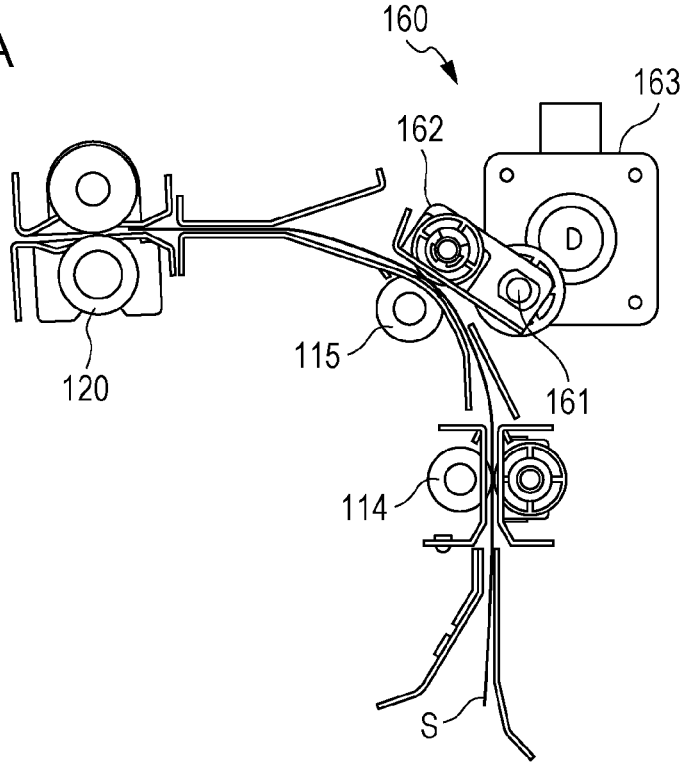
FIG. 12A illustrates the third embodiment of the skew correcting device.
Figure 12B:
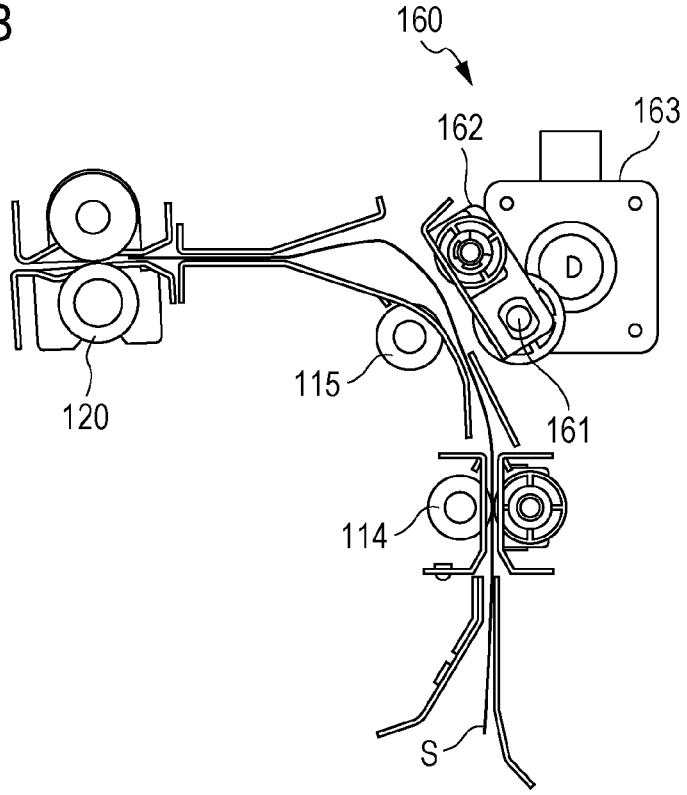
FIG. 12B illustrates the third embodiment of the skew correcting device.

As illustrated in FIG. 12A, a sheet is conveyed to the first roller pair 115 and stopped immediately before the nip of the registration roller pair 120. Then, before the sheet is fed again and brought into contact with the nip of the registration roller pair 120 to start formation of a loop, the first roller pair 115 is separated and the swinging guide 162 is swung upward. This is because if the swinging guide 162 is swung upward before the leading edge of the sheet passes through the first roller pair 115, the sheet may be buckled and the leading edge of the sheet may not be able to come into contact with the registration roller pair 120. Similarly, under the control of forming a loop without stopping the sheet immediately before the nip of the registration roller pair 120, it is preferable again that the swinging guide 162 be swung after the leading edge of the sheet passes through the first roller pair 115 and before formation of a loop starts.

In the configuration of the third embodiment, as illustrated in FIG. 12B, a loop is formed after the swinging guide 162 is moved upward to increase the loop space. Thus, since the swinging guide 162 does not interfere with the formation of a loop, a loop of desired size can be formed in the sheet. Also in the configuration of the third embodiment, it is possible to prevent an increase in loop reaction force caused by bringing a sheet having a loop into contact with the swinging guide 162. Thus, according to the configuration of the third embodiment, sheet skew correcting performance can be improved.

Note that the determination of sheet information, whether the separating mechanism 140 needs to separate the first roller 115*a*, and whether the loop-space varying mechanism 160 needs to separate the swinging guide 162 can be made in the same manner as in the first embodiment. Also, the flow of the sheet skew correcting operation of the skew correcting device 316 according to the third embodiment can be performed in the same manner as in the first embodiment.

Fourth Embodiment

Figure 13:
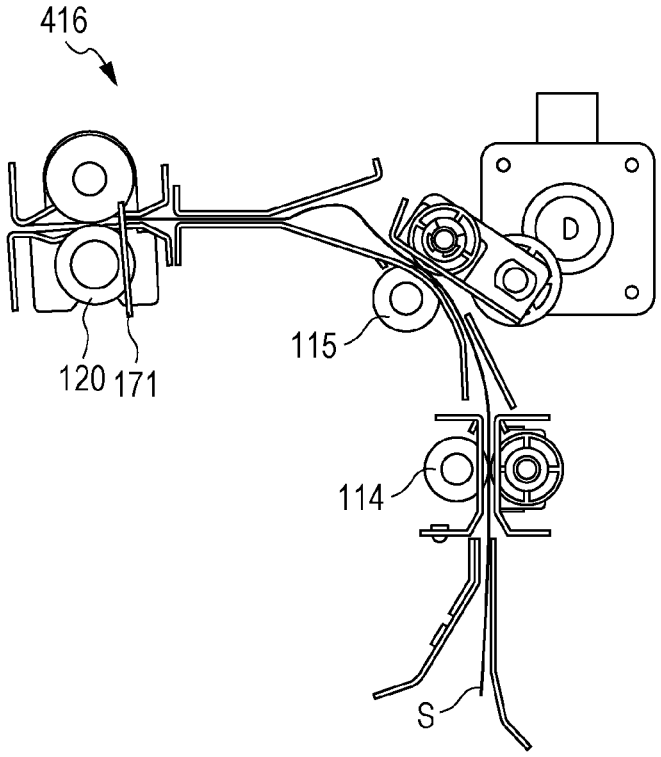
FIG. 13 illustrates a fourth embodiment of the skew correcting device.

A fourth embodiment of the present disclosure will now be described. FIG. 13 is a side view of a skew correcting device 416 according to the fourth embodiment. The fourth embodiment differs from the first embodiment only in that the skew correcting device 416 includes a shutter member 171 serving as a contact portion. The description of the other configurations, which are the same as those of the first embodiment, will be omitted here.

In the first embodiment, skew of a sheet is corrected by bringing the leading edge of the sheet into contact with the nip of the registration roller pair at rest. In the fourth embodiment, however, skew of a sheet is corrected by bringing the leading edge of the sheet into contact with the shutter member 171 of planar shape.

In the fourth embodiment, the shutter member 171 is disposed downstream of the first roller pair 115 and upstream of the registration roller pair 120. The shutter member 171 is projected to and retracted from the conveying path by a drive unit (not shown). When the shutter member 171 is projected to the conveying path, the leading edge of the conveyed sheet is brought into contact with the shutter member 171, so that skew of the sheet is corrected. Then, the shutter member 171 is retracted from the conveying path. The sheet is conveyed to the pair of registration rollers 120 and further to the image forming unit. Unlike in the embodiments described above, the registration roller pair 120 is configured to simply convey a conveyed sheet to the image forming unit, and does not have to stop the sheet to form a loop in the sheet.

The shutter member may be disposed downstream of the registration roller pair 120. In this case, it is necessary to provide a separating mechanism for separating and closing the registration roller pair 120. Specifically, the registration roller pair 120 is separated when the leading edge of the sheet is to be brought into contact with the shutter member 171. Then, after a loop is formed in the sheet and skew correction is completed, the registration roller pair 120 is closed to nip the sheet. After the shutter member 171 is retracted, the registration roller pair 120 starts rotating to convey the sheet to the image forming unit.

Embodiments of the present invention have been described in detail. The first to fourth embodiments described above may be used in combination with one another.

According to the present disclosure, the switching mechanism changes the nipping force of the first roller pair. The control unit controls the switching mechanism for changing the nipping force of the first roller pair on the basis of sheet information. It is thus possible to improve the performance of correcting skew of various types of sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2011/077457, filed Nov. 29, 2011, which is hereby incorporated by reference herein in its entirety.

The invention claimed is:

1. A skew correcting device comprising:

a first roller pair configured to nip and convey a sheet;

a second roller pair disposed upstream of the first roller pair and configured to nip and convey the sheet;

a contact portion disposed downstream of the first roller pair, the contact portion being a portion that a leading edge of the conveyed sheet comes into contact to correct skew of the sheet;

a separating mechanism configured to separate the first roller pair wherein, in a case that the separating mechanism separates the first roller pair before the leading edge of the conveyed sheet comes into contact with the contact portion to form a loop in the sheet for skew correction the loop is formed between the contact portion and the second roller pair, and in a case that the separating mechanism does not separate the first roller pair before the leading edge of the conveyed sheet comes into contact with the contact portion to form a loop in the sheet for skew correction, the loop is formed between the contact portion and the first roller pair; and a control unit configured to make a determination as to whether the separating mechanism separates the first roller pair or not separate the first roller pair on the basis of sheet information of the conveyed sheet.

2. The skew correcting device according to claim 1, wherein the separating mechanism makes the nipping force for nipping the sheet become a value of zero by separating the first roller pair.

3. The skew correcting device according to claim 1, wherein the first roller pair includes a first upper roller and a first lower roller, and the switching mechanism is a pressing-force varying mechanism configured to change a pressing force of the first upper roller against the first lower roller.

4. The skew correcting device according to claim 1, further comprising:

a swingable swinging guide configured to form a sheet conveying path; and a loop-space varying mechanism configured to swing the swinging guide to increase a loop space on the sheet conveying path.

5. The skew correcting device according to claim 1, wherein the contact portion is a nip of a registration roller pair which conveys the sheet to an image forming portion.

6. The skew correcting device according to claim 1, wherein the contact portion is a shutter member projected to a sheet conveying path.

7. The skew correcting device according to claim 1, wherein the sheet information is information about a size or a basis weight of the sheet.

8. The skew correcting apparatus comprising according to claim 7, wherein the control unit separates the first roller pair in a case where a size of the conveyed sheet in a width direction is a first size, and the control unit does not separate the first roller pair in a case where the size of the conveyed sheet in the width direction is a second size smaller than the first size.

9. The skew correcting apparatus comprising according to claim 7, wherein the control unit separates the first roller pair in a case where a basis weight of the conveyed sheet is a first basis weight, and the control unit does not separate the first roller pair in a case where the basis weight of the conveyed sheet is a second basis weight larger than the first basis weight.

10. The skew correcting apparatus comprising according to claim 1, wherein the first roller pair includes a first upper roller and a first lower roller, and the separating mechanism is configured to separate the first upper roller from the first lower roller.

11. An image forming apparatus comprising:

the skew correcting device according to claim 1; and an image forming unit configured to form an image on a sheet conveyed by the skew correcting device.

12. The skew correcting apparatus comprising according to claim 1, wherein the control unit is configured to make a determination as to whether the nipping force of the first roller pair is to be either reduced by the control unit adjusting the separating mechanism to separate the first roller pair, or increased by the control unit adjusting the separating mechanism to bring into contact the first roller pair, on the basis of sheet information.

13. The skew correcting apparatus comprising according to claim 1, wherein in the case that the separating mechanism does not separate the first roller pair before the leading edge of the conveyed sheet comes into contact with the contact portion to form a loop in the sheet for skew correction, the separating mechanism also does not separate the first roller pair after the leading edge of the conveyed sheet comes into contact with the contact portion.

14. The skew correcting apparatus comprising according to claim 1, further comprising an input unit for allowing a user to input sheet information of the conveyed sheet, wherein the control unit is configured to make the determination as to whether the separating mechanism separates the first roller pair or not separate the first roller pair on the basis of an input result of the input unit.

15. The skew correcting apparatus comprising according to claim 1, further comprising a detection unit configured to detect input sheet information of the conveyed sheet, wherein the control unit is configured to make the determination as to whether the separating mechanism separates the first roller pair or not separate the first roller pair on the basis of a detection result of the detection unit.

* * * * *